US007140587B1

(12) United States Patent
Diggle, III et al.

(10) Patent No.: US 7,140,587 B1
(45) Date of Patent: Nov. 28, 2006

(54) SUPPORT DEVICE

(75) Inventors: Frederick James Diggle, III, Birmingham, AL (US); Michael L. White, Boaz, AL (US)

(73) Assignee: BellSouth Intellectual Property Corp., Wilmington, DE (US)

( * ) Notice: Subject to any disclaimer, the term of this patent is extended or adjusted under 35 U.S.C. 154(b) by 0 days.

(21) Appl. No.: 10/641,311

(22) Filed: Aug. 14, 2003

(51) Int. Cl.
*A47L 3/04* (2006.01)

(52) U.S. Cl. ..... 248/339; 248/215; 182/36

(58) Field of Classification Search ..... 248/295.11, 248/296.1, 60, 27.7; 182/9, 133–136
See application file for complete search history.

(56) References Cited

U.S. PATENT DOCUMENTS

| | | | | | |
|---|---|---|---|---|---|
| 117,413 | A | * | 7/1871 | Hanger | 182/134 |
| 1,271,583 | A | | 7/1918 | Ketler | |
| 1,721,516 | A | | 7/1929 | Jacobs | |
| 2,152,049 | A | | 3/1939 | Hedrick | |
| 2,252,998 | A | | 9/1941 | Wachtel | |
| 2,290,318 | A | | 7/1942 | Deike, Jr. | |
| 2,544,963 | A | | 3/1951 | Livingston | |
| 2,910,135 | A | | 10/1959 | Moore | |
| 3,530,996 | A | | 9/1970 | Schaffer | |
| 3,647,171 | A | | 3/1972 | Rafferty | |
| 3,743,050 | A | | 7/1973 | Danz | |
| 3,776,549 | A | | 12/1973 | Ganis | |
| 3,787,015 | A | | 1/1974 | Ablelt | |
| 3,840,091 | A | | 10/1974 | Conlon | |
| 4,137,995 | A | | 2/1979 | Fonte | |
| 4,159,044 | A | | 6/1979 | Wydia | |
| 4,225,013 | A | | 9/1980 | Sampler | |
| 4,358,080 | A | * | 11/1982 | Wolker | 248/68.1 |
| 4,407,391 | A | | 10/1983 | Greenway et al. | |
| 4,506,762 | A | | 3/1985 | Bednar | |
| 4,527,660 | A | | 7/1985 | Andruchiw | |
| 4,572,329 | A | * | 2/1986 | Kleveborn | 182/9 |
| 4,679,658 | A | | 7/1987 | Demers | |
| 4,876,810 | A | * | 10/1989 | Piana et al. | 40/316 |
| 4,923,048 | A | | 5/1990 | Cole | |
| 4,951,778 | A | | 8/1990 | Halvorson | |
| 5,052,514 | A | | 10/1991 | Rezmer | |
| 5,165,499 | A | | 11/1992 | Bell | |
| 5,180,030 | A | | 1/1993 | Smaby | |
| 5,190,392 | A | | 3/1993 | Parma | |
| D335,351 | S | * | 5/1993 | Melnick | D24/186 |
| 5,222,991 | A | | 6/1993 | Bell | |
| 5,341,896 | A | | 8/1994 | Amacker | |
| 6,041,891 | A | * | 3/2000 | Fullam et al. | 182/134 |
| 6,070,849 | A | * | 6/2000 | Larmande et al. | 248/610 |
| 6,076,633 | A | | 6/2000 | Whitmer | |

(Continued)

OTHER PUBLICATIONS

United States Application; Express Mail Label No. EU 560 994 055 US.

(Continued)

*Primary Examiner*—Carl D. Friedman
*Assistant Examiner*—Steven Marsh
(74) *Attorney, Agent, or Firm*—Withers & Keys, LLC

(57) ABSTRACT

A support device may be used by a technician when performing elevated line work, for example. The support device may include a body portion having a ring portion extending from one end of the body portion. The support device also may include first and second hanger portions extending from the body portion. The first hanger portion may include a circular slot for engaging a rounded shaft, and the second hanger portion may include a flat slot for engaging a planar shaft.

13 Claims, 7 Drawing Sheets

U.S. PATENT DOCUMENTS 6,079,761 A * 6/2000 Sadeck ..... 294/82.1
6,206,138 B1 3/2001 Yerger
6,223,854 B1 5/2001 Nolz
6,241,045 B1 6/2001 Reeve et al.
6,471,002 B1 * 10/2002 Weinerman ..... 182/91
6,644,438 B1 11/2003 Chang et al.
6,752,242 B1 6/2004 Whitehead et al.
6,779,738 B1 * 8/2004 Stannard ..... 238/14

OTHER PUBLICATIONS

U.S. Appl. No. 10/409,013, filed Apr. 8, 2003.
U.S. Appl. No. 10/639,973, filed Aug. 13, 2003.
U.S. Appl. No. 10/646,137, filed Aug. 22, 2003.
U.S. Appl. No. 10/650,276, filed Aug. 27, 2003.

* cited by examiner

SUPPORT DEVICE

FIELD

The invention, in various embodiments, relates generally to devices and methods for their manufacture and use in working on, for example, utility poles.

BACKGROUND

In the telecommunications or electronics industry, it is common practice for a technician (also referred to as a "linesman") to scale a utility pole. The technician scales the utility pole to install equipment, to repair broken or damaged communications equipment, to test equipment, and/or for other work-related reasons. To safely and effectively scale a pole and perform line work, the technician must maintain and properly utilize various types of scaling and safety equipment. To utilize the various types of scaling and safety equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt. The technician then wraps the safety strap around the pole and reattaches the end of the safety strap to the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap.

SUMMARY

In one general aspect, a support device may be used by a technician when performing elevated line work, for example. The support device may include a body portion having a ring portion extending from one end of the body portion. The support device also may include first and second hanger portions extending from the body portion. The first hanger portion may include a circular slot for engaging a rounded shaft, and the second hanger portion may include a flat slot for engaging a planar shaft.

Implementations may include one or more of the following features. For example, the body portion, the ring portion, the first hanger portion, and the second hanger portion may be formed integrally with each other and/or constructed of metal, such as stainless steel and/or titanium. The first hanger portion and the second hanger portion may extend from opposed sides of the body portion. The body portion may include a hole between the first hanger portion and the second hanger portion. The ring portion may have a curved inside surface.

In some embodiments, the support device may include: a flat-blade screwdriver head on the body portion, dimples on at least one of the first hanger portion and the second hanger portion, bumps on at least one of the first hanger portion and the second hanger portion, a hex key tip on the body portion, a flat edge on at least one of the first hanger portion and the second hanger portion, a notch on at least one of the first hanger portion and the second hanger portion, and/or a belt loop on the ring portion.

In another general aspect, a unitary support device may include first hanging means for engaging a hook member having a rounded shaft, second hanging means for engaging a hook member having a planar shaft, and supporting means for supporting equipment. Implementations may include adjusting means, shorting means, and/or hand-line carrier means.

In another general aspect, a support assembly may include a hook member and a support device. The hook member may have a shaft embedded in and projecting from a utility pole. The support device may have a ring portion and a hanger portion extending from a body portion. The hanger portion may include a slot engaging the shaft of the hook member. In some implementation, the hook member may include a curved portion, a ring portion, and/or a pusher.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

Figure 1A:
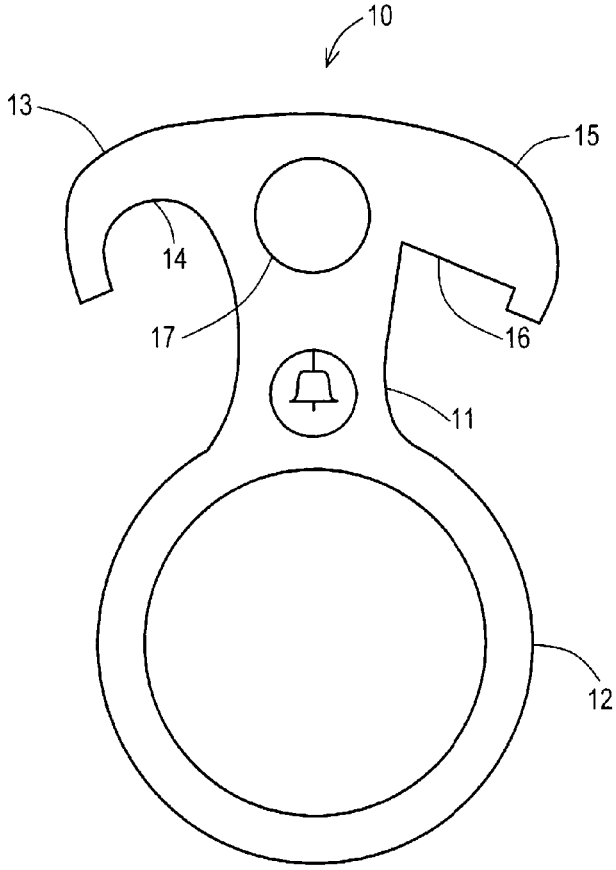
FIGS. 1A and 1B illustrate one embodiment of a support device.

FIG. 1A illustrates one embodiment of a support device 10. As shown, the support device 10 may include a body portion 11 and a ring portion 12 extending from one end of the body portion 11. In general, the ring portion 12 may be structured and arranged to support various items including, but not limited to, equipment, hardware, and/or safety equipment used by a technician when performing elevated line work, for example. The ring portion 12 also may be used, for example, to clip the support device 10 to the belt of a technician. In some implementations, rope or wire may be passed through the ring portion 12.

The support device 10 also may include a first hanger portion 13 extending outwardly from the body portion 11. In one implementation, the first hanger portion 13 has a circular slot 14 for engaging a rounded shaft of a hook member (e.g., J hook). In some implementations, the support device 10 may be hung from a strand when the technician is on a ladder working on a stranded plant, for example. The support device 10 also may have a second hanger portion 15 that extends outwardly from the body portion 11 and includes a flat slot 16 for engaging a planar shaft of a hook member.

In this embodiment, the support device 10 also may include a hole 17 through the body portion 11 between the first hanger portion 13 and the second hanger portion 15. The hole 17 may be used, for example, to clip the support device 10 to the belt of a technician. In some implementations, rope or wire may be passed through the hole 17.

Figure 1B:
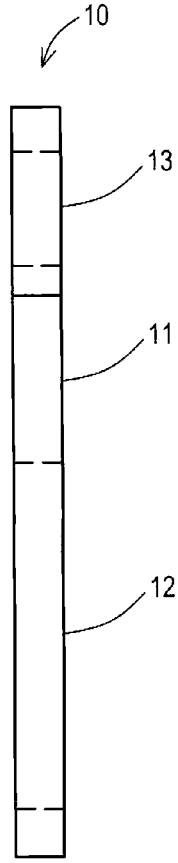

Referring to FIG. 1B, the support device 10 may be constructed so as to have a relatively thin and flat design. In general, this facilitates transport and use by a technician when performing elevated line work. In one embodiment, the first hanger portion 13 and the second hanger portion 15 extend outwardly from opposed sides of the support device 10 to achieve the relatively thin and flat design.

It can be appreciated that the choice of materials for construction of the support device 10 may be driven, at least in part, by the motivation to create an apparatus that is relatively lightweight, relatively compact and structurally sound and suitable for supporting items as intended during the use of such an apparatus. Materials for the support device 10 may include, where appropriate and suitable for the reasonably safe and functional practice of the various embodiments described herein, one or more of the following materials: metals such as steel, aluminum, for example, titanium and/or stainless steel or any other metal or alloy capable of withstanding stress and strain.

Figure 2A:
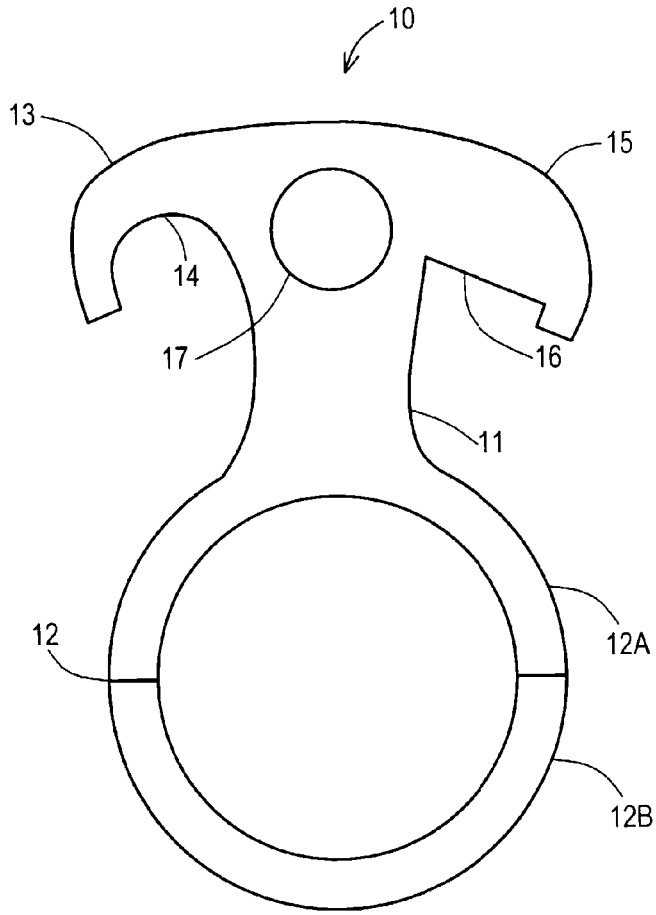
FIGS. 2A and 2B illustrate one embodiment of a support device.

FIG. 2A illustrates another embodiment of the support device 10. As shown, the support device 10 again includes a ring portion 12 extending from one end of the body portion 11. The support device 10 also includes a first hanger portion 13 having a rounded slot 14 and a second hanger portion 15 having a flat slot 16. The first hanger portion 13 and the second hanger portion 15 extend outwardly from opposed sides of the support device 10 and are separated by a hole 17.

Figure 2B:
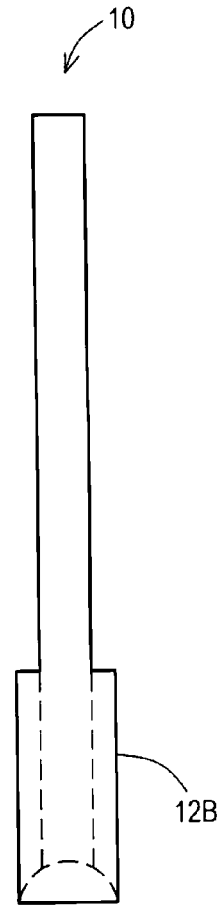

In this embodiment, the ring portion 12 includes an upper ring portion 12*a* and a lower ring portion 12*b*. The lower ring portion 12*b* may have a broad, gently curved inside surface to accommodate ropes and/or wires. In general, this makes the support device 10 useful in situations where a technician passes rope and/or wires through the ring portion 12 by reducing the likelihood of a snag. As shown in FIG. 2B, the lower ring portion 12*b*, in this embodiment, may be thicker than other portions of the support device 10.

Figure 3A:
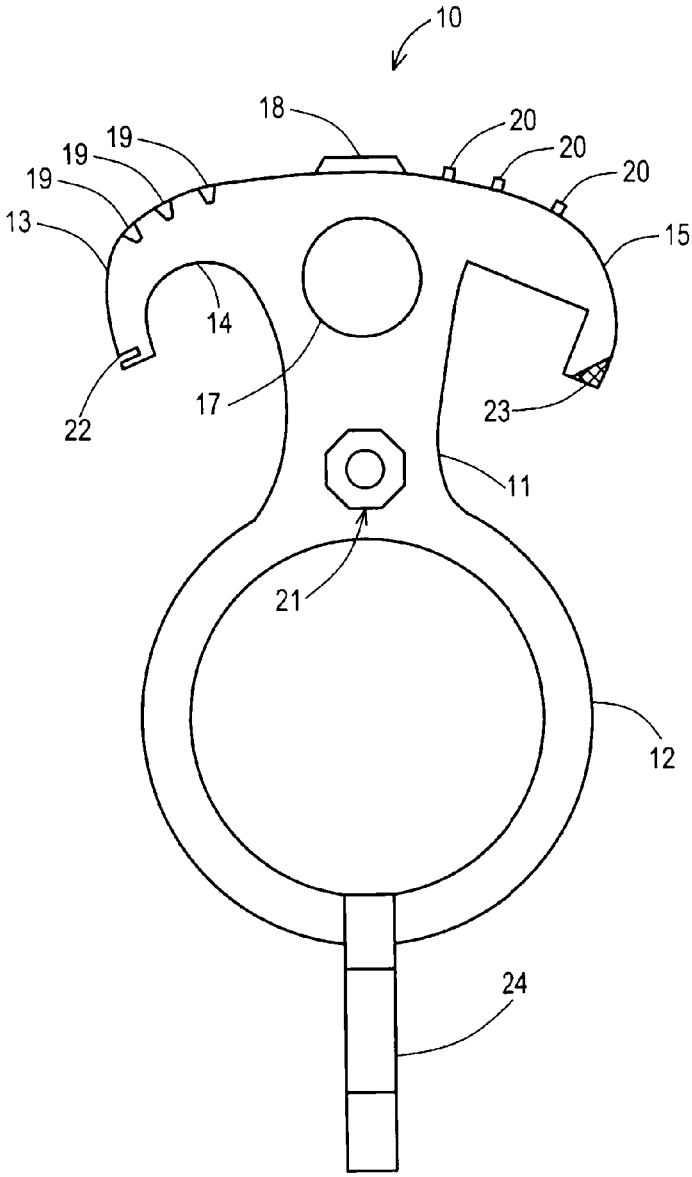
FIGS. 3A and 3B illustrate one embodiment of a support device.

FIG. 3A illustrates another embodiment of a support device. The support device 10 again includes a body portion 11 having a ring portion 12 extending therefrom. A first hanger portion 13 having a rounded slot 14 and a second hanger portion 15 having a flat slot 16 also extend from the body portion 11. The body portion 11 further includes a hole 17 positioned between the first hanger portion 13 and the second hanger portion 15.

As shown, the support device 10 may be provided with additional features for extending the usefulness of the device. For example, the support device 10 may include a flat-blade screwdriver head 18 on the body portion 11. In one embodiment, the flat-blade screwdriver head 18 may be positioned on the end of the body portion 11 opposite the ring portion 12.

The support device 10 also may include a plurality of dimples 19 and/or a plurality of bumps 20. In one implementation, the dimples 19 may be structured and arranged to short wire-wrap binding posts in central offices, and the bumps 20 may be structured and arranged to short screw-headed pairs. In one embodiment, the dimples 19 are provided on the first hanger portion 13 and the bumps 20 are provided on the second hanger portion 15. The positioning of the dimples 19 and bumps 20 may vary in alternate embodiments.

The support device 10 also may include a hex key tip 21 on the body portion 11. In one implementation, the hex key tip 21 may be used as a door key to open outside terminal boxes and/or SLC cabinets.

The support device 10 further may include a notch 22 and/or a flat edge 23 (e.g. 0.030 in flat). In one implementation, the notch 22 and/or the flat edge 23 may be structured and arranged to adjust spark plugs. In one embodiment, the notch 22 is provided on the first hanger portion 13 and the flat edge 23 is provided on the second hanger portion 15. The positioning of the notch 22 and/or the flat edge 23 may vary in alternate embodiments.

The support device 10 also may include a belt loop 24 so that the support device 10 may be used as a hand-line carrier. In one implementation, the belt loop 24 may be configured to fail if exposed to a predetermined tension (e.g. 20 lbs.). For the support device 10 to function as a hand-line carrier, wires may be fished through the ring portion 12, the hole 17, or draped over the hangers 13, 15 (which would be upside down). The support device 10 would be clipped to the belt of a technician using the belt loop 24. The belt loop 24 may be designed to fail (i.e. release) if tension exceeding a predetermined amount is experienced, for example, if the wire is caught during ascent.

Figure 3B:
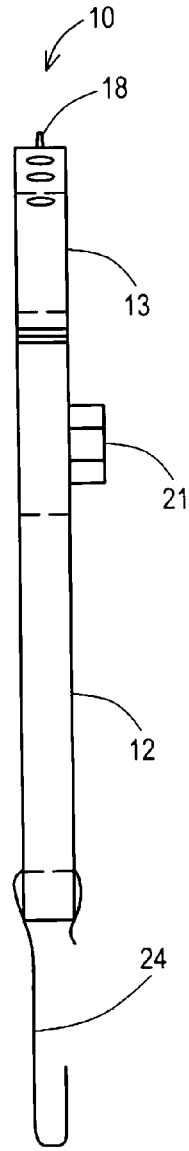

Referring to FIG. 3B, the belt loop 24 may be constructed so as to have a relatively thin design. In general, the shape, width, and/or thickness of the belt loop 24 may be configured so that failure occurs at the desired tension.

As described above, in some implementations, the support device 10 may be hung from a strand when the technician is on a ladder working on a stranded plant, for example. In other implementations, the support device 10 may be hung from a hook member.

Figure 4A:
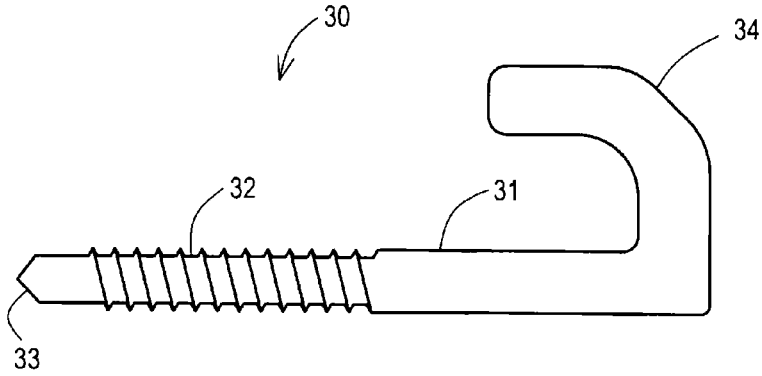
FIGS. 4A and 4B illustrate one embodiment of a hook member.
Figure 4B:
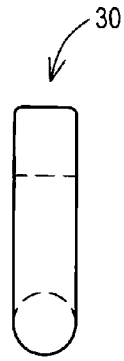

Referring to FIGS. 4A and 4B, one embodiment of a hook member 30 is illustrated. As shown, the hook member 30 includes a shaft 31 having threads 32 and a pointed tip 33. The hook member 30 also includes a curved portion 34 extending from the end of the shaft 31. In some cases, a technician may drive the hook member 30 into a utility pole such that the curved portion 34 projects outwardly from the pole and the threads 32 and pointed tip 33 are embedded in the pole.

Figure 4C:
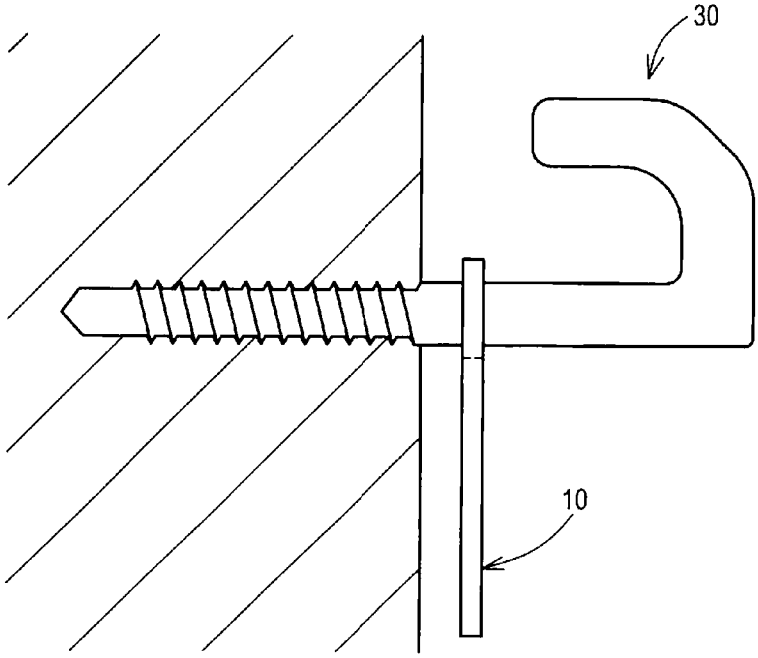
FIG. 4C illustrates one embodiment of a support member and hook member.

Referring to FIG. 4C, once the hook member 30 is secured to a utility pole, for example, the technician may hang the support device 10. In this embodiment, the shaft 31 may be rounded. In one implementation, the first hanger portion 13 having the circular slot 14 may be used to hang the support device 10 from the rounded shaft 31 of the hook member 30.

Figure 5B:
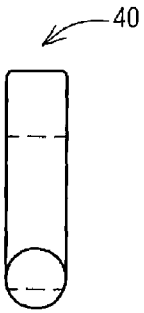
FIGS. 5A and 5B illustrate one embodiment of a hook member.
Figure 5A:
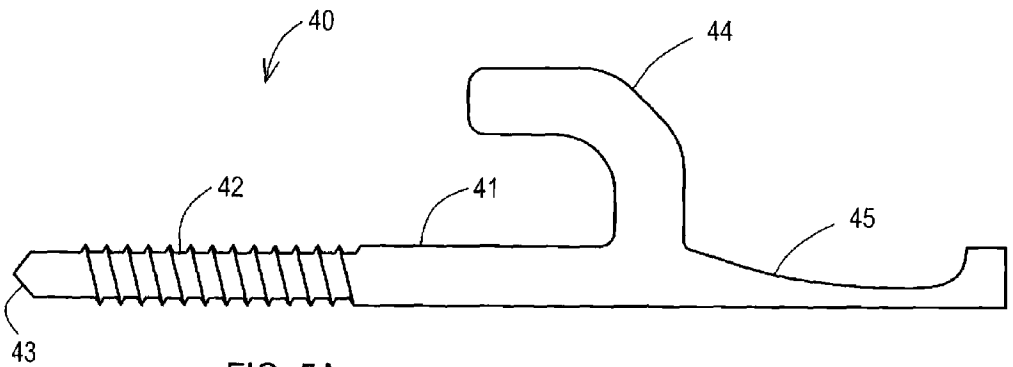

Referring to FIGS. 5A and 5B, another embodiment of a hook member 40 is illustrated. As shown, the hook member 40 includes a shaft 41 having threads 42 and a pointed tip 43. The hook member 40 also includes a curved portion 44 and a pusher 45. In one implementation, the pusher 45 may be hooked and tapered. In some cases, a technician may drive the hook member 40 into a utility pole such that the curved portion 44 and the pusher 45 project outwardly from the pole and the threads 42 and pointed tip 43 are embedded in the pole.

Figure 5C:
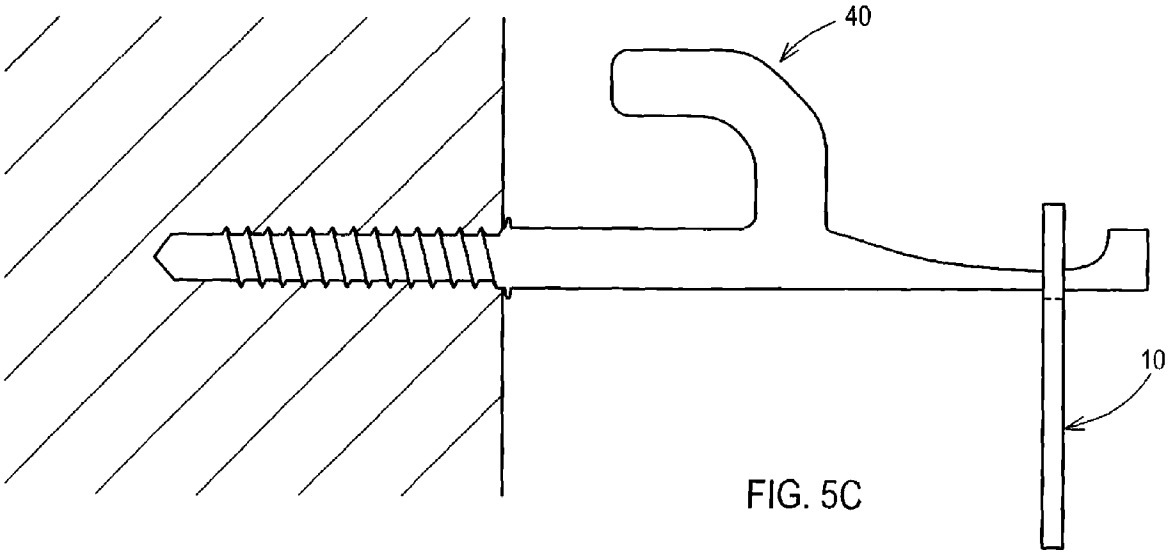
FIG. 5C illustrates one embodiment of a support member and hook member.

Referring to FIG. 5C, once the hook member 40 is secured to a utility pole, for example, the technician may hang the support device 10. In this embodiment, the pusher 45 may have a planar shaft. In one implementation, the second hanger portion 15 having the flat slot 16 may be used to hang the support device 10 from the planar shaft of the pusher 45 of the hook member 40.

Figure 6B:
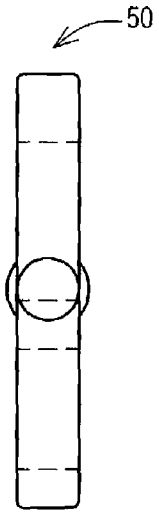
FIGS. 6A–6C illustrate one embodiment of a hook member.
Figure 6A:
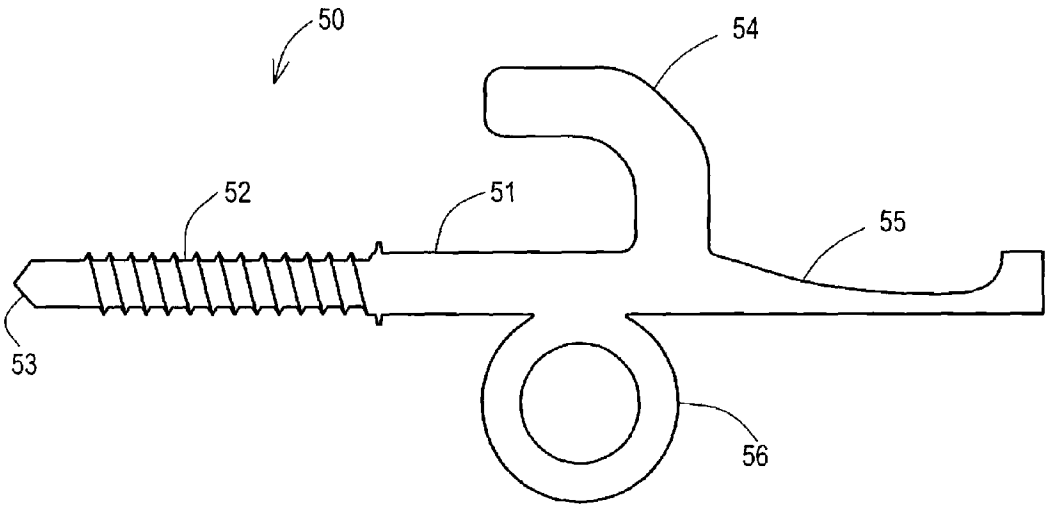
Figure 6C:
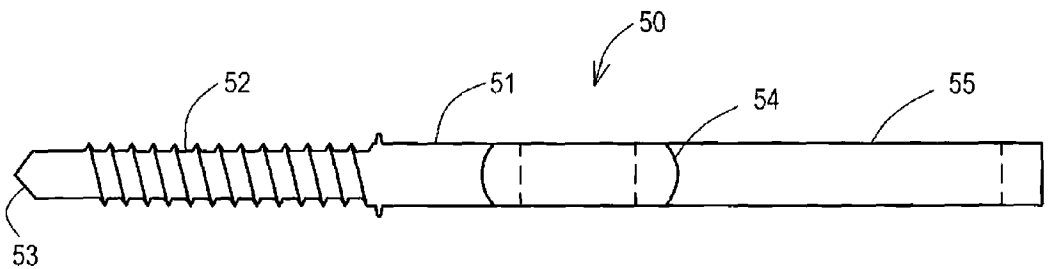

Referring to FIGS. 6A–6C, another embodiment of a hook member 50 is illustrated. As shown, the hook member 50 includes a shaft 51 having threads 52 and a pointed tip 53. The hook member 50 also includes a curved portion 54, a hooked and tapered pusher 55, and a ring portion 56. In some cases, a technician may drive the hook member 50 into a utility pole such that the curved portion 54, the pusher 55, and the ring portion 56 project outwardly from the pole and the threads 52 and pointed tip 53 are embedded in the pole.

In some implementations, a technician may hang a support device 10 from the hook member 50. For example, the first hanger portion 13 having a circular slot 14 may be used to hang the support device 10 from the rounded shaft 51 of the hook member 50. In some cases, the second hanger portion 15 having a flat slot 16 may be used to hang the support device 10 from the planar shaft of the pusher 55.

Figure 7:
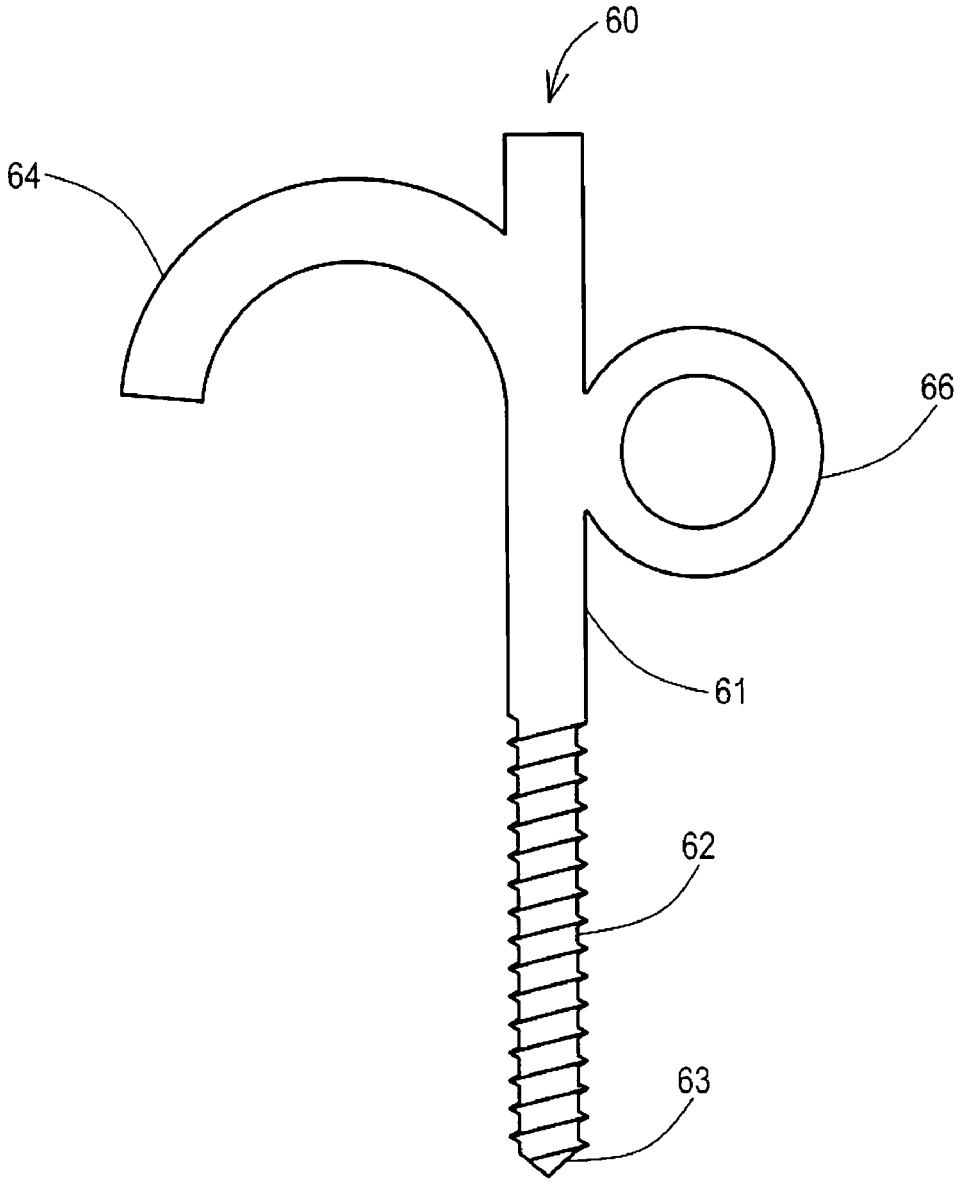
FIG. 7 illustrates one embodiment of a hook member.

FIG. 7 illustrates another embodiment of a hook member 60. As shown, the hook member 60 includes a shaft 61 having threads 62 and a pointed tip 63. The hook member 60 also includes a curved portion 64 and a ring portion 66. In some cases, a technician may drive the hook member 60 into a utility pole such that a curved portion 64 and the ring portion 66 project outwardly from the pole and the threads 62 and pointed tip 63 are embedded in the pole.

In some implementations, a technician may hang a support device 10 from the hook member 64. For example, the first hanger portion 13 having a rounded slot 14 may be used to hang the support device 10 from the rounded shaft 61 of the hook member 60.

The examples presented herein are intended to illustrate potential implementations of the present method and system embodiments. It can be appreciated that such examples are intended primarily for purposes of illustration. No particular aspect or aspects of the example method and system embodiments described herein are intended to limit the scope of the present invention. The configuration and specific functions of a particular support bracket, for example, are provided merely for convenience of disclosure.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

It can be appreciated that, in some embodiments of the present methods and systems disclosed herein, a single component can be replaced by multiple components, and multiple components replaced by a single component, to perform a given function. Except where such substitution would not be operative to practice the present methods and systems, such substitution is within the scope of the present invention.

Whereas particular embodiments of the invention have been described herein for the purpose of illustrating the invention and not for the purpose of limiting the same, it can be appreciated by those of ordinary skill in the art that numerous variations of the details, materials and arrangement of parts may be made within the principle and scope of the invention without departing from the invention as described in the appended claims.

What is claimed is:

1. A support device comprising:

a body portion with a first end and a second end and having a width between the first end and second end;

a ring portion extending from the first end of the body portion and having an aperture that has a diameter greater than the width of the body portion;

a first hanger portion extending arcuately from the second end of the body portion, the first hanger portion including an arcuate slot for engaging a rounded shaft; and a second hanger portion extending arcuately from the second end of the body portion and in a direction opposite to the first hanger portion, the second hanger portion including a flat slot for engaging a planar shaft, wherein the flat slot faces the ring portion.

2. The device of claim 1, wherein the body portion, the ring portion, the first hanger portion, and the second hanger portion are formed integrally with each other.

3. The device of claim 1, wherein at least one of the body portion, the ring portion, the first hanger portion, and the second hanger portion comprises stainless steel.

4. The device of claim 1, wherein at least one of the body portion, the ring portion, the first hanger portion, and the second hanger portion comprises titanium.

5. The device of claim 1, wherein the body portion includes a hole between the first hanger portion and the second hanger portion.

6. The device of claim 1, wherein the ring portion has a curved inside surface.

7. The device of claim 1, further comprising a flat-blade screwdriver head on the body portion.

8. The device of claim 1, further comprising dimples on at least one of the first hanger portion and the second hanger portion.

9. The device of claim 1, further comprising bumps on at least one of the first hanger portion and the second hanger portion.

10. The device of claim 1, further comprising a hex key tip on the body portion.

11. The device of claim 1, further comprising a flat edge on at least one of the first hanger portion and the second hanger portion.

12. The device of claim 1, further comprising a notch on at least one of the first hanger portion and the second hanger portion.

13. The device of claim 1, further comprising belt loop on the ring portion.

* * * * *